US010018038B2

(12) United States Patent
Feng et al.

(10) Patent No.: US 10,018,038 B2
(45) Date of Patent: Jul. 10, 2018

(54) DRILLING TYPE SIDEWALL CORING APPARATUS

(71) Applicants: China National Offshore Oil Corporation, Beijing (CN); China Oilfield Services Limited, Langfang (CN)

(72) Inventors: Yongren Feng, Langfang (CN); Zhibin Tian, Langfang (CN); Tao Lu, Langfang (CN); Liping Liu, Langfang (CN); Guiqing Hao, Langfang (CN); Wenquan Zhang, Langfang (CN); Xiaodong Chu, Langfang (CN); Zanqing Wei, Langfang (CN); Tiemin Liu, Langfang (CN); Fen Han, Langfang (CN)

(73) Assignees: China National Offshore Oil Corporation, Beijing (CN); China Oilfield Services Limited, Beijing (CN)

( * ) Notice: Subject to any disclaimer, the term of this patent is extended or adjusted under 35 U.S.C. 154(b) by 0 days.

(21) Appl. No.: 14/898,144

(22) PCT Filed: Sep. 19, 2014

(86) PCT No.: PCT/CN2014/086986
§ 371 (c)(1),
(2) Date: Dec. 14, 2015

(87) PCT Pub. No.: WO2016/004680
PCT Pub. Date: Jan. 14, 2016

(65) Prior Publication Data

US 2017/0107813 A1 Apr. 20, 2017

(30) Foreign Application Priority Data

Jul. 8, 2014 (CN) ..... 2014 1 0324549

(51) Int. Cl.
*E21B 49/06* (2006.01)
*E21B 4/04* (2006.01)
(Continued)

(52) U.S. Cl.
CPC ..... *E21B 49/06* (2013.01); *E21B 4/006* (2013.01); *E21B 4/04* (2013.01); *E21B 4/16* (2013.01); *E21B 4/18* (2013.01); *E21B 23/01* (2013.01)

(58) Field of Classification Search
None
See application file for complete search history.

(56) References Cited

U.S. PATENT DOCUMENTS 4,714,119 A * 12/1987 Hebert ..... E21B 49/06 175/20
5,411,106 A * 5/1995 Maissa ..... E21B 49/06 175/250
(Continued)

FOREIGN PATENT DOCUMENTS

CN 2288269 Y 8/1998
CN 2881097 Y 3/2007
(Continued)

*Primary Examiner* — Shane Bomar
(74) *Attorney, Agent, or Firm* — Ling Wu; Stephen Yang; Ling and Yang Intellectual Property

(57) ABSTRACT

A drilling type sidewall coring apparatus, comprising: a main body, a transmission device, a bit mounted on the transmission device, a rack accommodated in the main body, and a plurality of first hydraulic oil cylinders, the transmission device mounted on the rack in a rotatable manner, the first hydraulic oil cylinders mounted on the main body, pistons of the first hydraulic oil cylinders connected with the rack, the telescopic motion of the pistons of the first hydraulic oil cylinders driving the rack to perform radial motion in the main body so as to make the bit protrude or retract from the main body. The electric motor is mounted in the main
(Continued)

body and connected with the right angel speed reducer by the soft shaft. The electric motor transmits power by the soft shaft and the right angle speed reducer to drive the bit to rotate, the transmission efficiency is higher.

18 Claims, 5 Drawing Sheets

(51) Int. Cl.

| | |
|---|---|
| ***E21B 4/00*** | (2006.01) |
| ***E21B 4/16*** | (2006.01) |
| ***E21B 4/18*** | (2006.01) |
| *E21B 23/01* | (2006.01) |

(56) References Cited

U.S. PATENT DOCUMENTS

| | | | | |
|---|---|---|---|---|
| 2006/0081398 | A1* | 4/2006 | Arian | E21B 49/06 175/58 |
| 2010/0282516 | A1* | 11/2010 | Buchanan | E21B 47/0002 175/58 |
| 2013/0068531 | A1 | 3/2013 | Joulin et al. | |
| 2013/0277118 | A1* | 10/2013 | Koch | E21B 7/046 175/78 |

FOREIGN PATENT DOCUMENTS

| | | | |
|---|---|---|---|
| CN | 101037941 | A | 9/2007 |
| CN | 101446197 | A | 6/2009 |
| CN | 101666217 | A | 3/2010 |
| CN | 203626676 | U | 6/2014 |
| WO | WO2010021725 | A1 | 2/2010 |

* cited by examiner

DRILLING TYPE SIDEWALL CORING APPARATUS

TECHNICAL FIELD

The embodiments of the present invention relate to the field of petroleum exploration, in particular to a drilling type sidewall coring apparatus.

BACKGROUND OF THE RELATED ART

The drilling type sidewall coring apparatus is a petroleum exploration apparatus. US patent US 2013/0068531A1 discloses a drilling type sidewall coring apparatus. As shown in FIG. 1, a coring apparatus 100 is lowered into a well, a bit 1002 drills into the formation, perpendicular to the sidewall, for coring and core folding operations, and the bit 1002 completes the core-pushing operation after retracting into a main body 1001. The operation process of the coring apparatus 100 is: a ground panel controls an electric motor of the downhole coring apparatus 100, the electric motor drives a hydraulic pump to produce high pressure to drive a backup arm 1003 to deploy such that the coring apparatus is fixed in the depth of coring and is pressed firmly against the sidewall; meanwhile, the high pressure produced by the hydraulic system drives a hydraulic motor, the hydraulic motor drives the diamond bit to screw into the formation; after drilling to the target length, the rock core of the formation is obtained by the action of core folding.

The bit of the above coring apparatus is mounted on the hydraulic motor and the power transmission line of driving the bit is: electric motor→hydraulic pump→hydraulic motor→bit. However, the power transmission efficiency of hydraulic pump and hydraulic motor is very low, particularly when the temperature is of great changes, the viscosity of hydraulic oil varies a lot, even the efficiency is lower. Thus, the effective power transmitted from the electric motor to the bit 1002 is very small, about 20%. In order to guarantee the bit 1002 to have sufficient power to complete coring operation, the power of the electric motor must be very large, while the request for large power of the electric motor leads to the great difficulty of downhole power supply and higher risk. In addition, because the viscosity of hydraulic oil is mainly affected by the temperature, and the power transmission efficiency of hydraulic system is closely related with viscosity, the range of operating temperature of the instrument with one same hydraulic oil is narrower and it needs to frequently replace different hydraulic oil according to the different downhole operating temperature to complete coring operation.

The bit 1002 of the above coring apparatus needs to protrude to press firmly against the sidewall relative to the main body 1001 when drilling and the bit 1002 needs to be retracted into the main body 1001 after core folding. The mechanism for achieving protruding and retracting of the bit of the above coring apparatus comprises a first hydraulic oil cylinder mounted on the main body 1001, a long motion guide rail and a short motion guide rail; the protruding or retracting of the bit 1002 relative to the main body 1001 can be achieved relying on the drive of the first hydraulic oil cylinder and the cooperative movement of a sliding block mounted on the hydraulic motor with the long motion guide rail and short motion guide rail. Such achievement depends on the design of the track and the request for manufacturing precision of the apparatus is higher.

The bit 1002 of the above coring apparatus needs to be rotated to make the bit 1002 rotate to the core pushing position (at this time, the axial direction of the bit is parallel to the axial direction of the main body) to complete core pushing operation, or rotate the bit 1002 to the initial position (at this time, the axial direction of the bit is perpendicular to the axial direction of the main body). The above coring apparatus needs to drive the bit to swing at the coring position to complete core folding operation. The above coring apparatus drives the hydraulic motor by a piston of a second hydraulic oil cylinder and a linkage mechanism and is cooperatively moved with the long motion guide rail and short motion guide rail relying on the sliding block mounted on the hydraulic motor to achieve the rotation and swing of the bit 1002. Since the achievement depends on the design of the track, the request for manufacturing precision of the apparatus is higher. Besides, because when the bit 1002 protrudes and retracts, the position of the second hydraulic oil cylinder and the linkage mechanism relative to the hydraulic motor is varying, thus the core folding operation can be completed only when the coring depth of the bit 1002 is sufficiently deep. If the bit 1002 gets stuck to not reach the appointed depth during the coring process, the core folding and coring cannot be achieved.

CONTENT OF THE INVENTION

One of the objects of the embodiments of the present invention is to provide a sidewall coring apparatus with higher drilling efficiency.

The embodiments of the present invention provide a drilling type sidewall coring apparatus, comprising: an electric motor, a bit, a soft shaft and a speed reducer, one end of the soft shaft being connected with an output shaft of the electric motor and the other end of the soft shaft being connected with an input end of the speed reducer, and the bit being mounted on an output end of the speed reducer.

Preferably, the speed reducer is a right angle speed reducer.

The above sidewall coring apparatus uses the soft shaft and the speed reducer to transmit the power the bit needs when drilling, the efficiency of which is higher relative to the hydraulic pump and hydraulic motor and will not vary with the temperature. The success rate of coring is greatly increased without the need of frequently replacing the hydraulic oil. The workload of site maintenance is largely reduced and at the same time the risk of site operation is effectively reduced.

The other object of the embodiments of the present invention is to provide a sidewall coring apparatus with a simple and reliable telescopic mechanism of the bit.

The further object of the embodiments of the present invention is to provide a sidewall coring apparatus which can complete core folding without being limited to the coring depth.

The embodiments of the present invention provide a drilling type sidewall coring apparatus, comprising a main body, a transmission device, a bit mounted on the transmission device, a rack accommodated in the main body, and two or more first hydraulic oil cylinders, the transmission device mounted on the rack in a rotatable manner, the first hydraulic oil cylinders mounted on the main body, pistons of the first hydraulic oil cylinders connected with the rack, the telescopic motion of the pistons of the first hydraulic oil cylinders driving the rack to perform radial motion in the main body so as to make the bit protrude or retract from the main body.

Alternatively, the transmission device is a speed reducer, the drilling type sidewall coring apparatus further comprises a electric motor and a soft shaft, one end of the soft shaft is connected with an output shaft of the electric motor, the other end of the soft shaft is connected with an input end of the speed reducer and the bit is mounted on an output end of the speed reducer.

Alternatively, the drilling type sidewall coring apparatus further comprises a second hydraulic oil cylinder and a linkage mechanism, the second hydraulic oil cylinder being fixed on the rack, one end of the linkage mechanism being connected to a piston of the second hydraulic oil cylinder, the other end being connected to the transmission device, the telescopic motion of the piston of the second hydraulic oil cylinder driving the transmission device to rotate relative to the rack by the linkage mechanism so as to make the bit rotate or swing.

Alternatively, two sides of a housing of the transmission device are provided with a rotating shaft, the rotating shaft is sleeved in a connecting hole corresponding to two sides of the rack; a connecting point between the linkage mechanism and the transmission device is provided on the housing of the transmission device and deviates from the rotating shaft; and under the driving of the linkage mechanism, the transmission device rotates relative to the rack with the rotating shaft as the center.

Alternatively, the housing of the transmission device is further provided with a lug at one side or two sides thereof which is provided to deviate from the rotating shaft; and a first limiting groove for limiting the rotation of the lug within the range of 90 degrees is provided on a corresponding position of the rack.

Alternatively, the second hydraulic oil cylinders and the linkage mechanism are two in number, the linkage mechanism is a two connecting rods mechanism which comprises a first connecting rod being connected with the piston of the second hydraulic oil cylinder and a second connecting rod being connected with the transmission device, and a second liming groove for limiting the axial motion of the first connecting rod is provided on the rack.

Alternatively, there are 2N first hydraulic oil cylinders which are fixed on one side from which the bit protrudes out in the main body, wherein the pistons of N first hydraulic oil cylinders are fixedly connected with one side of the rack, and the pistons of another N first hydraulic oil cylinders are fixedly connected with the other side of the rack, wherein N is positive integer.

Alternatively, one or more angle sensors being provided to detect the rotation angle of the bit are mounted on the transmission device.

Alternatively, the electric motor is fixedly mounted on the main body.

The above drilling type sidewall coring apparatus is provided with the rack in the main body, the transmission device installed with the bit is mounted on the rack, using the hydraulic oil cylinder to directly drive the rack to perform radial motion in the main body so as to achieve the protruding and retracting of the bit, and the structure can be simply achieved and is reliable, which improves the precision of coring. Preferably, the second hydraulic oil cylinder and the linkage mechanism needed for achieving the rotation and swing of the bit are mounted on the rack, moving with the rack, so as to avoid the case of coring failure when the bit gets stuck.

PREFERRED EMBODIMENTS OF THE PRESENT INVENTION

The embodiments of the present invention will be described in detail below in conjunction with accompanying drawings. It should be illustrated that without a conflict, the embodiments in the present application and the features in the embodiments can be combined with each other randomly.

Figure 2:
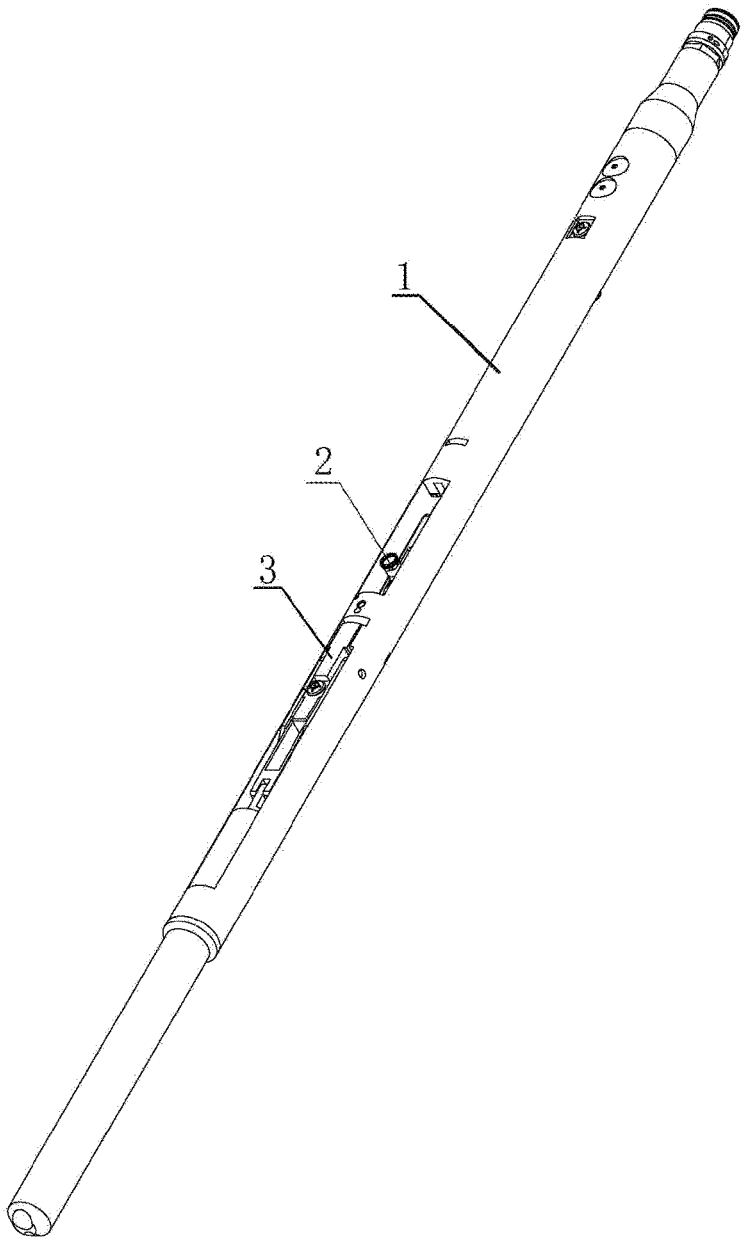
FIG. 2 is a perspective assembly diagram of the drilling type sidewall coring apparatus according to the embodiments of the present invention.
Figure 3:
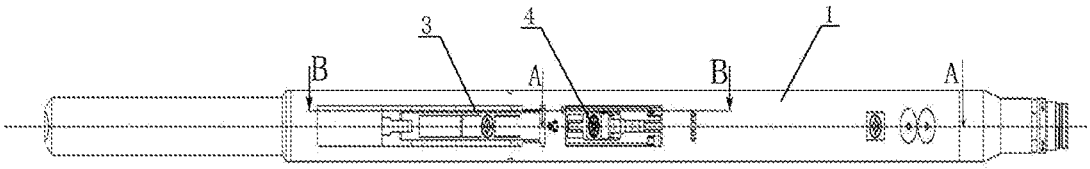
FIG. 3 is a top view of FIG. 2.

FIGS. 2 and 3 respectively show the perspective view and the top view of the drilling type sidewall coring apparatus according to the embodiments of the present invention. The sidewall coring apparatus according to the embodiments of the present invention comprises a main body 1, from the surface of which a right angle speed reducer 4, a backup arm 3 and the like can be observed.

Figure 4:
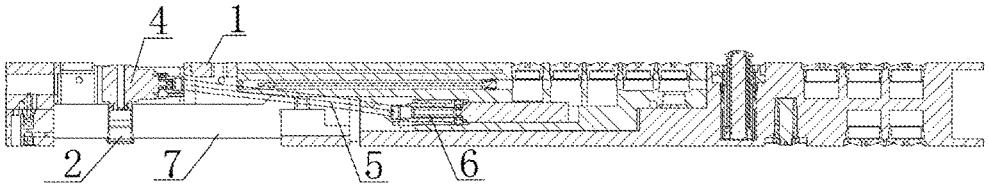
FIG. 4 is a sectional view of A-A shown in FIG. 3.
Figure 5:
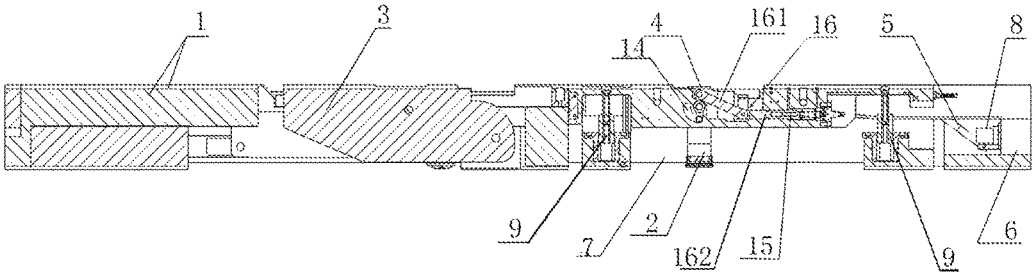
FIG. 5 is a sectional view of B-B shown in FIG. 3.

FIG. 4 is a sectional view of A-A shown in FIG. 3 and FIG. 5 is a sectional view of B-B shown in FIG. 3. A power mechanism for achieving the drilling of the bit shown in FIG. 4 comprises a bit 2, a right angle speed reducer 4, a soft shaft 5 and an electric motor 6, one end of the soft shaft 5 being connected with the output shaft of the electric motor 6, the other end being connected with the input end of the right angle speed reducer 4, and the bit 2 being mounted on the output end of the right angle speed reducer 4. So, the power transmission line of drilling the bit according to the embodiments of the present invention is: electric motor→soft shaft→speed reducer→bit, the efficiency of the soft shaft and the speed reducer is relatively higher than that of the hydraulic pump and hydraulic motor and will not vary with the temperature and the transmission efficiency thereof is proved to be about 60% via experiment, which is about 3 times that of the original one. The success rate of coring will be greatly increased if the power of the bit is sufficient. Since the hydraulic pump and the hydraulic motor are removed, the bit power is almost not affected by the temperature. The using scope is expanded from the varying scope of the temperature of 50° C. to 150° C. without the need of frequently replacing the hydraulic oil. The workload of site maintenance is largely reduced and the risk of site operation is effectively reduced.

Figure 6:
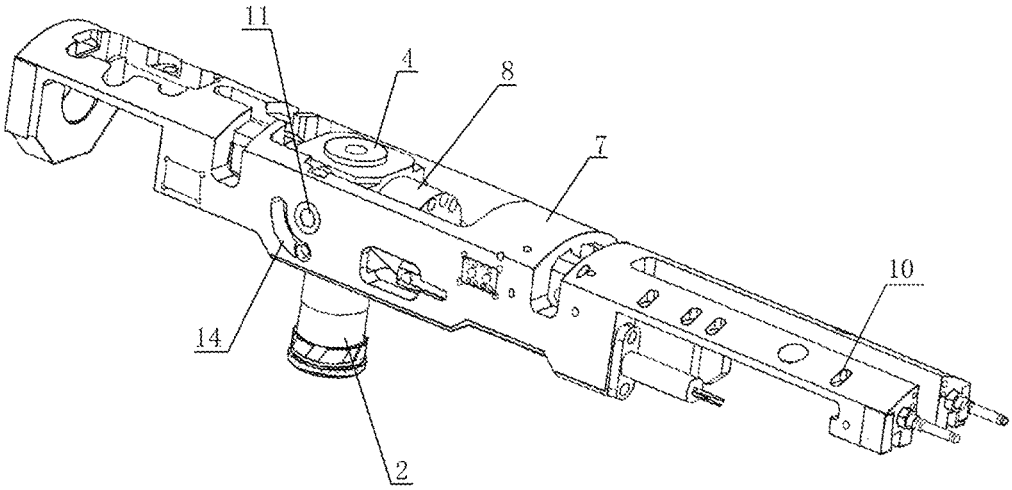
FIG. 6 is a perspective view of a rack 7 and the components mounted thereon after the stripping of a main body 1.
Figure 7:
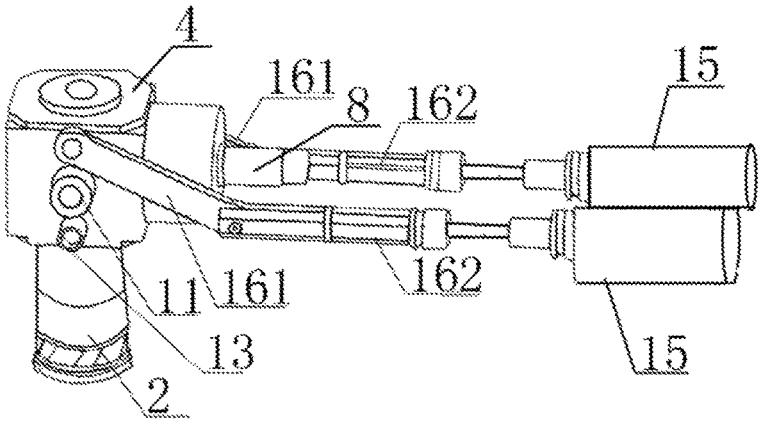
FIG. 7 is a perspective view of a bit 2, a right angle speed reducer 4 and related components connected with the right angle speed reducer 4 after the stripping of the rack 7.

The main body 1 of the sidewall coring apparatus according to the embodiments accommodates a rack 7, and the right angle speed reducer 4 installed with the bit 2 can be mounted on the rack 7 in a rotatable manner. Referring to FIGS. 4, 6 and 7, FIG. 6 is a perspective view of the rack 7 and the components mounted thereon after the stripping of a main body 1 and FIG. 7 is a perspective view of the bit 2, the right angle speed reducer 4 and related components connected with the right angle speed reducer 4 after the stripping of the rack 7. As shown in the Figures, the electric motor 6 is fixedly mounted on the main body 1 so as to avoid the line loosening of the electric motor 6. Since the electric motor 6 is connected with the right angle speed reducer 4 by the soft shaft 5, it will not affect the transmission. In addition, the soft shaft 5 can be connected with the right angle speed reducer 4 by a shaft coupling 8.

The bit 2 is indirectly mounted on the rack 7 by the right angle speed reducer 4. The telescopic motion of the bit 2 relative to the main body 1 is achieved by the radial motion of the rack 7 in the main body 1 according to the embodiments. Referring to FIGS. 5 and 6, four first hydraulic oil cylinders 9 are mounted on the side from which the bit 2 protrudes out in the main body 1. The pistons of the four first hydraulic oil cylinders 9 are fixedly connected with the four corners of the rack 7. FIG. 6 shows four connecting holes 10 on the rack 7 for connecting with the pistons. So, the protruding and retracting of the pistons of the first hydraulic oil cylinders 9 can drive the rack 7 to perform radial motion in the main body 1.

Figure 8:
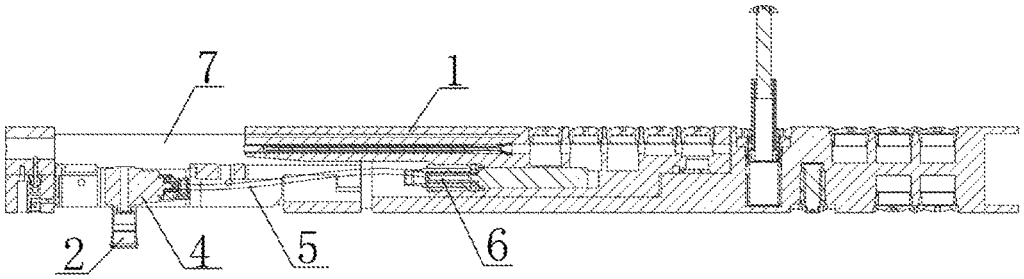
FIG. 8 is a sectional view of the same cutting position with FIG. 4 when the bit 2 has protruded from the main body 1 to reach the coring position.
Figure 9:
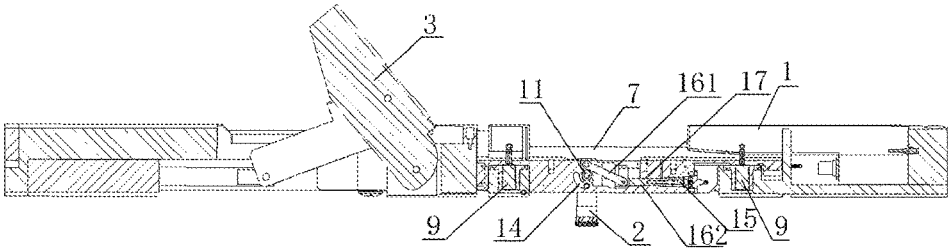
FIG. 9 is a sectional view of the same cutting position with FIG. 5 when the bit 2 has protruded from the main body 1 to reach the coring position.
Figure 10:
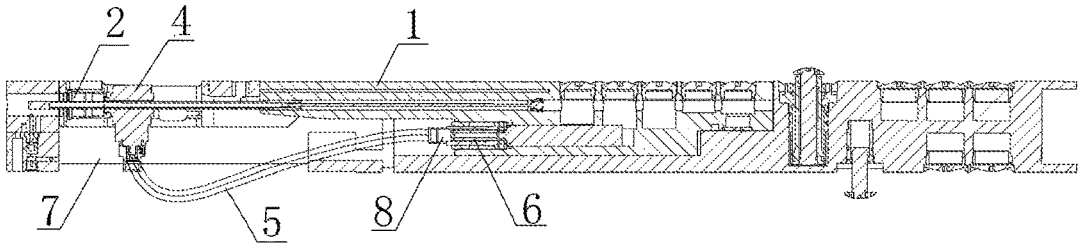
FIG. 10 is a sectional view of the same cutting position with FIG. 4 when the bit 2 rotates to the core pushing position.
Figure 11:
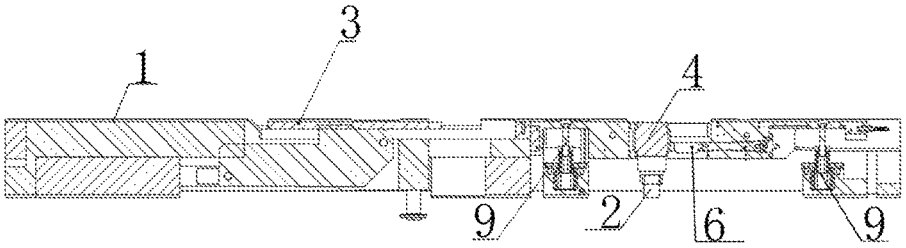
FIG. 11 is a sectional view of the same cutting position with FIG. 5 when the bit 2 rotates to the core pushing position.

As shown in FIGS. 4 and 5, the bit 2 is located in the initial position, at this time, the pistons of the first hydraulic oil cylinders 9 are in an extended state, and the rack 7 is located away from a side from which the bit 2 protrudes out in the main body 1. The pistons of the first hydraulic oil cylinders 9 retract when needs to core. The bit 2 is driven to move downward by the rack 7 so as to protrude from the main body 1 and press firmly against the sidewall. As shown in FIGS. 8 and 9, the bit 2 has protruded from the main body 1 and reached the coring position, at this time, the rack 7 has been pressed firmly against one side from which the bit protrudes out in the main body 1. After the coring is completed, the pistons of the first hydraulic oil cylinders 9 are extended, and the bit 2 retracts upward into the main body 1 by the rack 7 driving the bit 2. After reaching the initial position, the bit 2 reach the core pushing position by rotation, that is, the position of the bit 2 as shown in FIGS. 10 and 11.

The structure for achieving the protruding and retracting of the bit can be simply achieved and is reliable for the ease of controlling, which improves the precision of coring. Moreover, the position of the first hydraulic oil cylinder 9 is easy to be arranged and a sufficient number of the first hydraulic oil cylinders can be provided to guarantee the needed power according to the actual needs. For instance, the number of the first hydraulic oil cylinder can be provided as 2N, wherein the pistons of N first hydraulic oil cylinders are fixedly connected with one side of the rack, the pistons of the other N first hydraulic oil cylinders are fixedly connected with the other side of the rack, wherein N is positive integer.

Referring to FIGS. 5, 6 and 7, in order to achieve the rotation and swing of the bit 2, the two sides of the housing of the right angle speed reducer 4 are provided with a rotating shaft 11, and the rotating shaft 11 is sleeved in the connecting holes corresponding to the two sides of the rack 7. One side or two sides of the housing of the right angle speed reducer 4 is further provided with a lug 13 which is provided to deviate from the rotating shaft 11. A first limiting groove 14 for limiting the rotation of the lug 13 within the range of 90 degrees is provided on the position of the rack 7 corresponding to the lug 13. It is using a second hydraulic oil cylinder 15 to drive a linkage mechanism 16 to drive the rotation of the right angle speed reducer 4 according to the embodiments. As shown in FIG. 5, the second hydraulic oil cylinder 15 is fixed on the rack 7, one end of the linkage mechanism 16 is connected with the piston of the second hydraulic oil cylinder 15, the other end is connected with the right angle speed reducer 4, and the telescopic motion of the piston of the second hydraulic oil cylinder 15 drives the right angle speed reducer 4 to rotate relative to the rack 7 by the linkage mechanism 16 so as to make the bit 2 rotate or swing relative to the rack 7 (also relative to the main body 1).

As shown in FIGS. 6 and 7, the connecting point between the linkage mechanism 16 and the right angle speed reducer 4 is provided on the housing of the right angle speed reducer 4 and deviates from the rotating shaft 11. Under the driving of the linkage mechanism 16, the right angle speed reducer 4 rotates relative to the rack 7 with the rotating shaft 11 as the center. In the embodiment shown in FIG. 7, there are two second hydraulic oil cylinders 15 and two linkage mechanisms 16, while the linkage mechanism 16 is a two connecting rods mechanism (the embodiments of the present invention are not limited to this), comprising a first connecting rod 162 being connected with the piston of the second hydraulic oil cylinder 15 and a second connecting rod 161 being connected with the right angle speed reducer. A second limiting groove 17 for limiting the axial motion of the first connecting rod 162 is provided on the rack 7. It should be illustrated that the connection and the position relation shown in FIG. 7 is merely exemplary, for instance, it may also provide two connecting portions on the top of the right angle speed reducer 4 to connect with one or two linkage mechanisms 16; for another instance, it may also provide the rotating shaft on the rack 7 and provide the shaft sleeve or the connecting hole on the housing of the right angle speed reducer 4 to achieve the rotary connection between the right angle speed reducer 4 and the rack 7; for further instance, the rotary direction of the bit 2 can be changed, etc.

Figure 1:
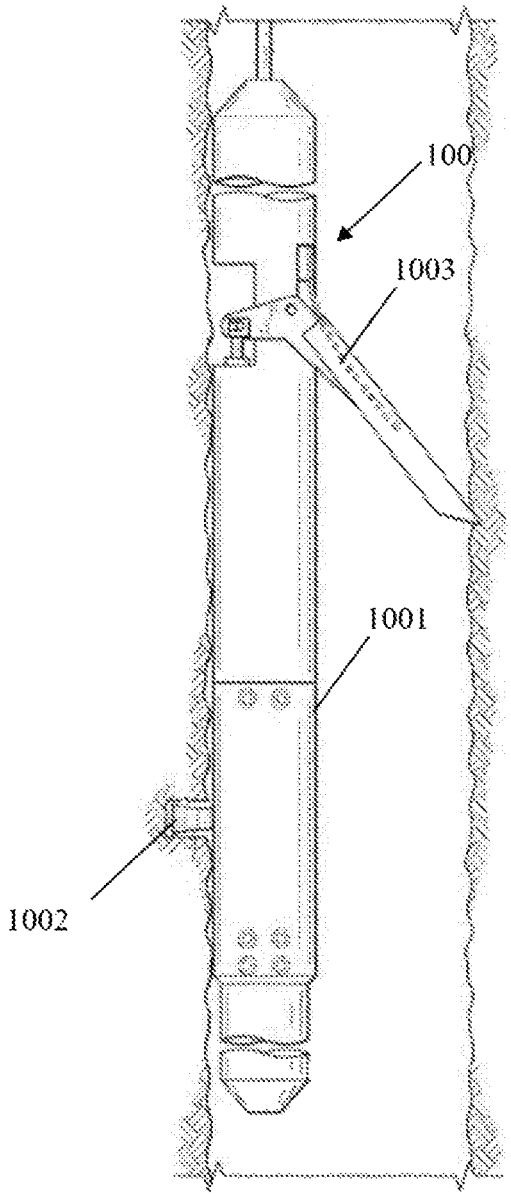
FIG. 1 Prior Art
FIG. 1 is a state diagram in use of the drilling type sidewall coring apparatus of the related art.

As shown in FIGS. 5 and 6, the bit 2 is in the initial position, at this time, the second hydraulic oil cylinder 15 is in an extended state, and the bit 2 is axially fixed in the position axially perpendicular to the main body 1 by the linkage mechanism 16. In FIG. 9, the bit 2 has moved to the coring position, at this time, the bit 2 protrudes into the sidewall (see FIG. 1), and the core folding operation can be achieved by repeatedly refueling and defueling the second hydraulic oil cylinder 15 and driving the right angle speed reducer 4 and the bit 2 to swing a certain angle via the linkage mechanism 16. Since the second hydraulic oil cylinder 15, the linkage mechanism 16 and the right angle speed reducer 4 are all carried on the rack 7, no matter how deep the drilling depth of the bit 2 is, the relative position of the second hydraulic oil cylinder 15, the linkage mechanism 16 and the right angle speed reducer 4 is unchanged. The second hydraulic oil cylinder 15, the linkage mechanism 16 and the right angle speed reducer 4 all can achieve swinging and core folding in the same manner so that the coring failure can be avoided when the bit 2 gets stuck during the coring. Since even if the bit gets stuck, it may take actions of breaking off the rock core at any time to successfully obtain the rock core.

After coring, the bit will retract into the initial position as shown in FIGS. 5 and 6, and at this time, the obtained rock core is in the bit 2 which is different from the initial state. At this time, the piston of the second hydraulic oil cylinder 15 retracts and the right angle speed reducer 4 and the bit 2 mounted thereon are driven to rotate by the linkage mechanism 16 (it is clockwise rotation in the Figure, but the present invention is not limited to this) so as to make the bit 2 rotate to the position axially parallel to the main body 1. As shown in FIGS. 10 and 11, the core pushing operation can be completed by the core pushing mechanism at this time.

The drilling type sidewall coring apparatus according to the embodiments of the present invention switches the drilling power mechanism to the soft shaft and speed reducer (not limiting to the right angle speed reducer) to transmit power; the protruding and retracting of the bit is achieved by providing the rack, the first hydraulic oil cylinder; and meanwhile, the rotation of the bit is simplified by fixing the second hydraulic oil cylinder on the rack. It is easily understood that, in another embodiment, the efficiency can be improved merely by using the drilling power mechanism according to the embodiments. While in another embodiment, the mechanism for achieving the protruding and retracting of the bit is merely used according to the embodiments, at this time, the transmission device of the bit does not need to use the right angle speed reducer and may also use the hydraulic motor and the like. In addition, when using the mechanism for the protruding and retracting of the bit according to the embodiments, it may also, at the same time, use or not use the rotary mechanism of the bit according to the embodiments.

INDUSTRIAL APPLICABILITY

The drilling type sidewall coring apparatus according to the embodiments of the present invention switches the drilling power mechanism to use the soft shaft and speed reducer to transmit power, the transmission efficiency of which is about 3 times that of the original one. The power of the bit is sufficient and the success rate of coring is greatly increased. The power of the bit is almost not affected by the temperature, and the using scope is expanded from the varying scope of the temperature of 50° C. to 150° C. without the need of frequently replacing the hydraulic oil. The workload of site maintenance is largely reduced and the risk of site operation is effectively reduced.

The drilling type sidewall coring apparatus according to the embodiments of the present invention is provided with the rack in the main body, the transmission device installed with the bit is mounted on the rack, and the hydraulic oil cylinder is used to directly drive the rack to perform radial motion in the main body so as to achieve the protruding and retracing of the bit. The structure can be simply achieved and is reliable, which improves the precision of coring and avoids the coring failure when the bit gets stuck.

What is claimed is:

1. A drilling type sidewall coring apparatus, comprising: a main body, a transmission device, a bit mounted on the transmission device, a rack accommodated in the main body, two or more first hydraulic oil cylinders, a second hydraulic oil cylinder and a linkage mechanism, the transmission device is mounted on the rack in a rotatable manner, the first hydraulic oil cylinder is mounted on the main body, pistons of the first hydraulic oil cylinders are connected with the rack, a telescopic motion of the pistons of the first hydraulic oil cylinders drives the rack to perform radial motion in the main body so as to make the bit protrude or retract from the main body, the second hydraulic oil cylinder is fixed on the rack, one end of the linkage mechanism is connected to a piston of the second hydraulic oil cylinder, and the other end of the linkage mechanism is connected to the transmission device, a telescopic motion of the piston of the second hydraulic oil cylinder drives the transmission device to rotate relative to the rack by the linkage mechanism so as to make the bit rotate or swing.

2. A drilling type sidewall coring apparatus according to claim 1, wherein the transmission device is a speed reducer, the drilling type sidewall coring apparatus further comprises an electric motor and a soft shaft, one end of the soft shaft is connected with an output shaft of the electric motor, the other end of the soft shaft is connected with an input end of the speed reducer and the bit is mounted on an output end of the speed reducer.

3. A drilling type sidewall coring apparatus according to claim 1, wherein two sides of a housing of the transmission device is provided with a rotating shaft, the rotating shaft is sleeved in connecting holes corresponding on two sides of the rack; a connecting point between the linkage mechanism and the transmission device is provided in the housing of the transmission device and deviates from the rotating shaft; and under the driving of the linkage mechanism, the transmission device rotates relative to the rack with the rotating shaft as the center.

4. A drilling type sidewall coring apparatus according to claim 3, wherein the housing of the transmission device is further provided with a lug at one side or two sides thereof which is provided to deviate from the rotating shaft; and a first limiting groove for limiting the rotation of the lug within the range of 90 degrees is provided on a corresponding position of the rack.

5. A drilling type sidewall coring apparatus according to claim 4, wherein the second hydraulic oil cylinder and the linkage mechanism are two in number, the linkage mechanism is a two connecting rods mechanism which comprises a first connecting rod connected with the piston of the second hydraulic oil cylinder and a second connecting rod connected with the transmission device, and a second limiting groove for limiting the axial motion of the first connecting rod is provided on the rack.

6. A drilling type sidewall coring apparatus according to claim 1, wherein there are 2N the first hydraulic oil cylinders which are fixed on one side from which the bit protruding out in the main body, wherein the pistons of N first hydraulic oil cylinders are fixedly connected with one side of the rack, and the pistons of another N first hydraulic oil cylinders are fixedly connected with the other side of the rack, wherein N is positive integer.

7. A drilling type sidewall coring apparatus according to claim 1, wherein one or more angle sensors being provided to detect the rotation angle of the bit are mounted on the transmission device.

8. A drilling type sidewall coring apparatus according to claim 2, wherein the electric motor is fixedly mounted on the main body.

9. A drilling type sidewall coring apparatus, comprising an electric motor, a bit, a soft shaft and a speed reducer, one end of the soft shaft connected with an output shaft of the electric motor and the other end of the soft shaft connected with an input end of the speed reducer, and the bit being mounted on an output end of the speed reducer, wherein the drilling type sidewall coring apparatus further comprises a main body, a rack accommodated in the main body, a hydraulic oil cylinder and a linkage mechanism, the hydraulic oil cylinder is fixed on the rack, one end of the linkage mechanism is connected to a piston of the hydraulic oil cylinder, and the other end of the linkage mechanism is connected to the speed reducer, a telescopic motion of the piston of the hydraulic oil cylinder drives the speed reducer to rotate relative to the rack by the linkage mechanism so as to make the bit rotate or swing.

10. A drilling type sidewall coring apparatus according to claim 9, wherein the speed reducer is a right angle speed reducer.

11. A drilling type sidewall coring apparatus according to claim 2, wherein there are 2N the first hydraulic oil cylinders which are fixed on one side from which the bit protruding out in the main body, wherein the pistons of N first hydraulic oil cylinders are fixedly connected with one side of the rack, and the pistons of another N first hydraulic oil cylinders are fixedly connected with the other side of the rack, wherein N is positive integer.

12. A drilling type sidewall coring apparatus according to claim 3, wherein there are 2N the first hydraulic oil cylinders which are fixed on one side from which the bit protruding out in the main body, wherein the pistons of N first hydraulic oil cylinders are fixedly connected with one side of the rack, and the pistons of another N first hydraulic oil cylinders are fixedly connected with the other side of the rack, wherein N is positive integer.

13. A drilling type sidewall coring apparatus according to claim 4, wherein there are 2N the first hydraulic oil cylinders which are fixed on one side from which the bit protruding out in the main body, wherein the pistons of N first hydraulic oil cylinders are fixedly connected with one side of the rack, and the pistons of another N first hydraulic oil cylinders are fixedly connected with the other side of the rack, wherein N is positive integer.

14. A drilling type sidewall coring apparatus according to claim 5, wherein there are 2N the first hydraulic oil cylinders which are fixed on one side from which the bit protruding out in the main body, wherein the pistons of N first hydraulic oil cylinders are fixedly connected with one side of the rack, and the pistons of another N first hydraulic oil cylinders are fixedly connected with the other side of the rack, wherein N is positive integer.

15. A drilling type sidewall coring apparatus according to claim 2, wherein one or more angle sensors being provided to detect the rotation angle of the bit are mounted on the transmission device.

16. A drilling type sidewall coring apparatus according to claim 3, wherein one or more angle sensors being provided to detect the rotation angle of the bit are mounted on the transmission device.

17. A drilling type sidewall coring apparatus according to claim 4, wherein one or more angle sensors being provided to detect the rotation angle of the bit are mounted on the transmission device.

18. A drilling type sidewall coring apparatus according to claim 5, wherein one or more angle sensors being provided to detect the rotation angle of the bit are mounted on the transmission device.

* * * * *